US006880611B2

(12) United States Patent
Nien

(10) Patent No.: US 6,880,611 B2
(45) Date of Patent: Apr. 19, 2005

(54) HORIZONTAL VENETIAN BLIND SLAT STRUCTURE

(76) Inventor: Leslie Nien, No. 45-4, Fan Po St. Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/452,132

(22) Filed: Jun. 3, 2003

(65) Prior Publication Data

US 2004/0244920 A1 Dec. 9, 2004

(51) Int. Cl.[7] ..... E06B 9/00
(52) U.S. Cl. ..... 160/236
(58) Field of Search ..... 160/236, 232, 160/173 R, 178.1 R, 243, 231.1

(56) References Cited

U.S. PATENT DOCUMENTS

| | | | | |
|---|---|---|---|---|
| 1,252,112 A * | 1/1918 | Hough | 160/231.1 |
| 2,156,163 A * | 4/1939 | Pierce | 160/236 |
| 2,244,300 A * | 6/1941 | Doin | 160/196.1 |
| 2,275,975 A * | 3/1942 | McGlone | 160/236 |
| 2,577,667 A * | 12/1951 | Waite | 160/352 |
| 2,724,434 A * | 11/1955 | Smith | 160/348 |
| 5,896,903 A * | 4/1999 | Chen et al. | 144/350 |
| 6,192,949 B1 * | 2/2001 | Nien | 144/350 |
| 6,276,429 B1 * | 8/2001 | Chen | 160/231.1 |
| 6,378,567 B1 * | 4/2002 | Chen | 139/383 R |
| 6,546,980 B1 * | 4/2003 | Chen | 144/350 |
| 6,622,763 B1 * | 9/2003 | Chen | 144/350 |

* cited by examiner

*Primary Examiner*—David Purol
(74) *Attorney, Agent, or Firm*—Troxell Law Office, PLLC

(57) ABSTRACT

A horizontal Venetian blind slat structure includes a plurality of horizontal rods and binding cords wherein the horizontal rods are made of elongated natural materials such as bamboo or wooden sticks, and the binding cords are of different colors and patterns. The horizontal rods arranged in parallel are bound into a large piece via the binding cords weaving up and down the horizontal rods for combination thereof. Fastening glue is applied onto the binding cords to strengthen the combination thereof, and fissures are formed at the space between every two horizontal rods with no binding cords attached thereto. The large piece of horizontal rods bound via the binding cords is then cut into a blind slat of proper length with two cord-passage holes disposed at both ends thereof; whereby, via the binding cords of different colors and patterns, the blind slat is variably changed in beautiful display. Besides, the blind slat thereof is easily disposed of when out of use since the horizontal rods thereof can be quickly decomposed in soil without causing pollution to the environment thereof.

7 Claims, 4 Drawing Sheets

HORIZONTAL VENETIAN BLIND SLAT STRUCTURE

BACKGROUND OF THE INVENTION

The present invention is related to a horizontal Venetian blind slat structure, comprising a plurality of horizontal rods and binding cords wherein the horizontal rods are made of elongated natural materials such as bamboo or wooden sticks, and the binding cords are of different colors and patterns. The horizontal rods arranged in parallel are bound into a large piece via the binding cords with fastening glue applied onto the binding cords for further strengthening thereof. The large piece of horizontal rods is cut into a blind slat of proper length with two cord-passage holes disposed at both ends thereof; whereby, the blind slat, variably changed in colors and patterns via the binding cords, can be disposed of easily when out of use since the horizontal rods are quickly decomposed in soil without causing pollution to the environment thereof.

Please refer to FIG. 1. A conventional Venetian blind slat structure is mainly made up of a slat 1 of plastic materials. The slat 1 is molded into an elongated plate of proper strength and hardness with patterns 2 printed or hot-pressed at the surface thereon and cord-passage holes 3 punched at both ends thereof.

There are some drawbacks to such conventional Venetian blind slat. First, the slat 1 must be molded and injected into an elongated plate, which is complicated in the process thereof and difficult to produce on a massive scale. Second, patterns 2 are printed or hot-pressed on the surface of the slat 1 thereof, which may boost the cost of production. Third, the slat 1 made of plastic materials may cause pollution in disposal. In case of burning, the plastics of the slat 1 may cause air pollution. Yet, in case of covering by soil, the slat 1 still becomes garbage polluting the environment since it can't decompose itself in soil.

SUMMARY OF THE PRESENT INVENTION

It is, therefore, the primary purpose of the present invention to provide a horizontal Venetian blind slat structure, comprising a plurality of horizontal rods and binding cords wherein the horizontal rods arranged in parallel are bound into a large piece via the binding cords woven thereto with fastening glue applied onto the binding cords to strengthen the combination thereof. The large piece of horizontal rods is cut into a blind slat of proper length with two cord-passage holes disposed at both ends thereof; whereby, via the binding cords of different colors and patterns, the blind slat is variably changed in beautiful display.

It is, therefore, the secondary purpose of the present invention to provide a horizontal Venetian blind slat structure wherein the horizontal rods thereof are made of elongated natural materials such as bamboo or wooden sticks which can be decomposed in soil and easily disposed of in a short time without causing pollution to the environment thereof.

It is, therefore, the third purpose of the present invention to provide a horizontal Venetian blind slat structure wherein the large piece of the horizontal rods bound together via the binding cords and strengthened via fastening glue thereof is cut into a blind slat of proper length with two cord-passage holes disposed at both ends thereof, which can be economically produced on a massive scale.

DETAILED DESCRIPTION OF THE PREFERRED EMBODIMENTS

Figure 1:
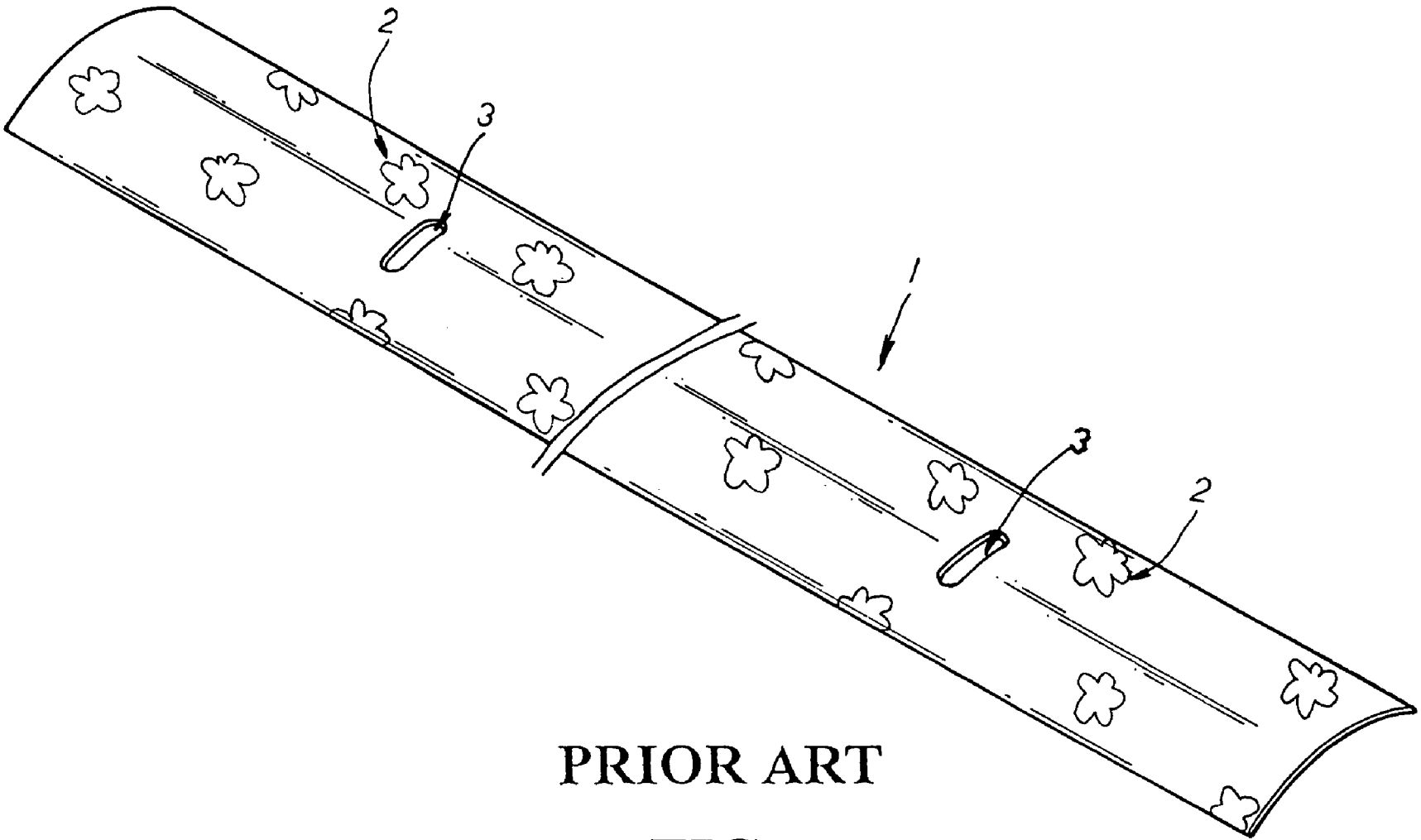
PRIOR ART FIG. 1
FIG. 1 is a perspective view of a conventional Venetian blind slat structure.
Figure 2:
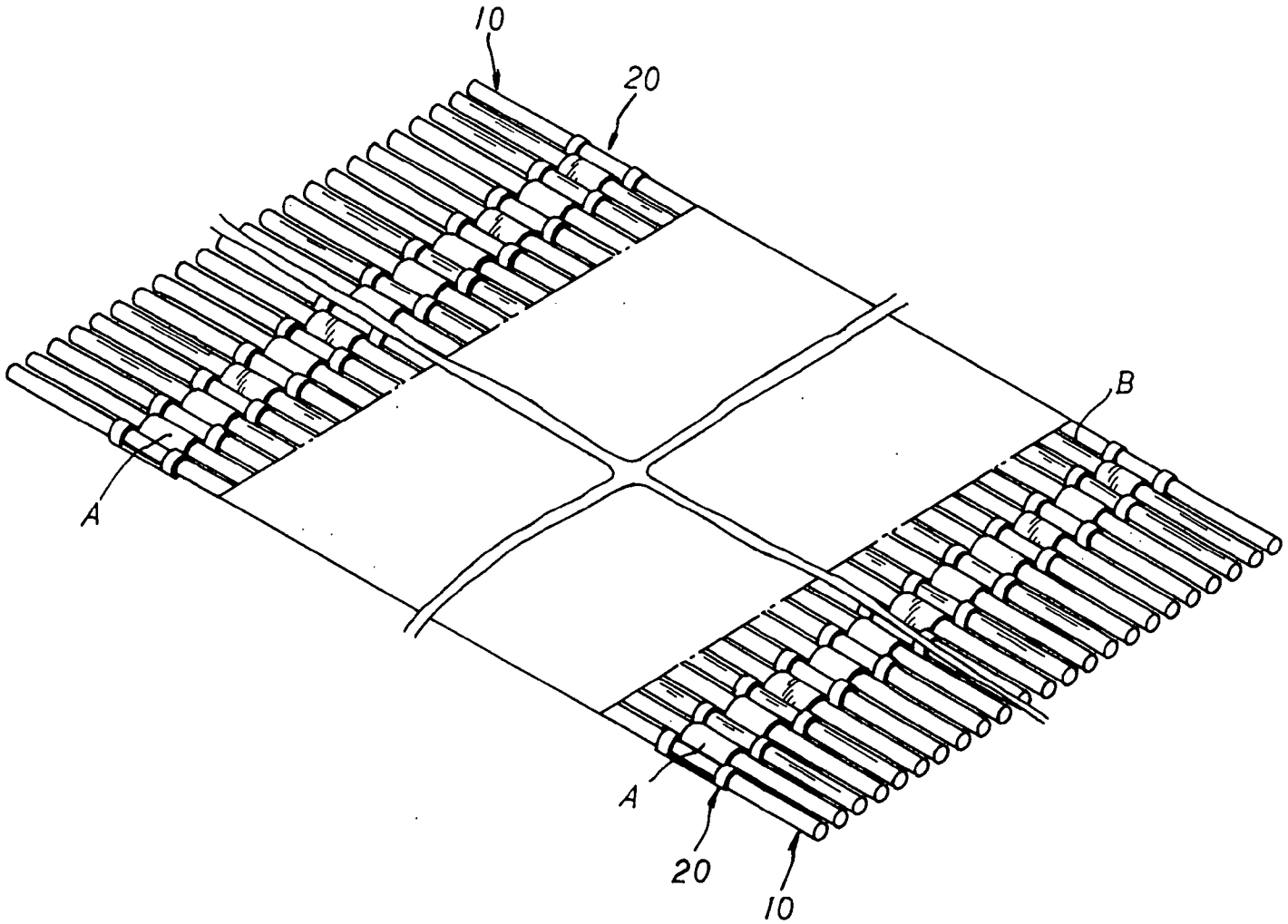
FIG. 2 is a perspective view of the present invention in half-produced stage.
Figure 3:
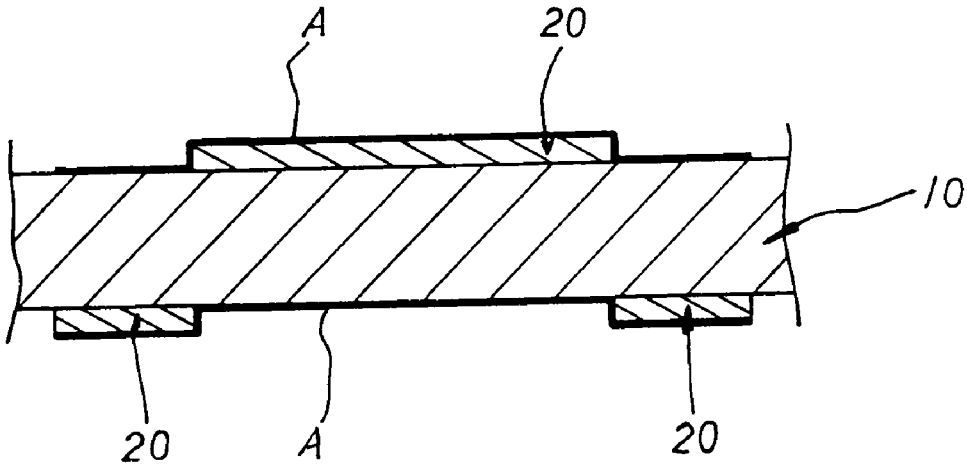
FIG. 3 is a sectional view of the present invention showing the combination of the binding cords with the horizontal rod thereof.
Figure 4:
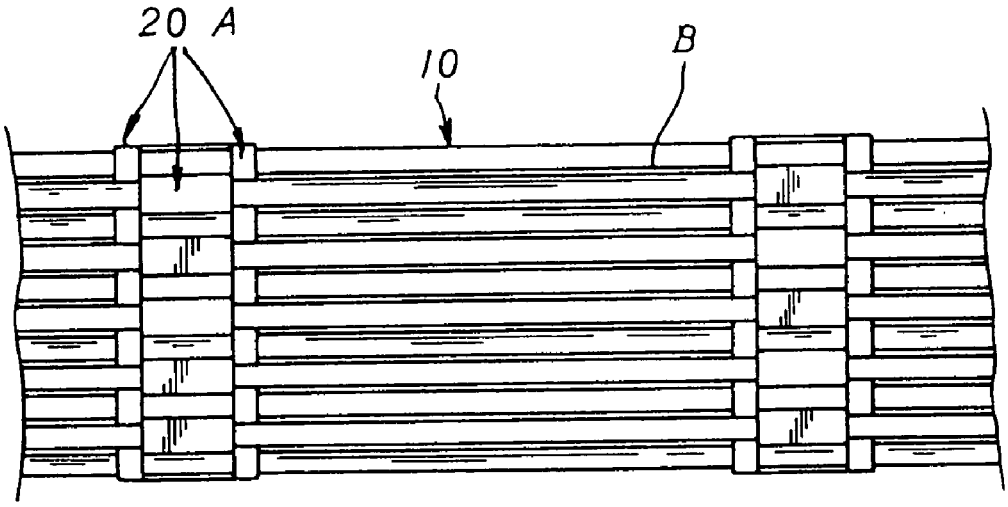
FIG. 4 is a partial top view of the present invention.

Please refer to FIG. 2. The present invention is related to a horizontal Venetian blind slat structure, comprising a plurality of horizontal rods 10 and binding cords 20. The horizontal rods 10 are made of elongated natural materials, such as bamboo sticks or wooden sticks, and the binding cords 20 are of different colors or patterns. The horizontal rods 10 are arranged in parallel and bound into a large piece via the binding cords 20 winding and weaving equidistantly up and down the horizontal rods 10 for combination thereof. Fastening glue A is then applied onto the binding cords 10 to strengthen the combination of the horizontal rods and the binding cords 20 thereof as shown in FIG. 3. Fissures B are disposed at the space defined by every two horizontal rods 10 with no binding cords 20 attached thereto as shown in FIG. 4.

Figure 5:
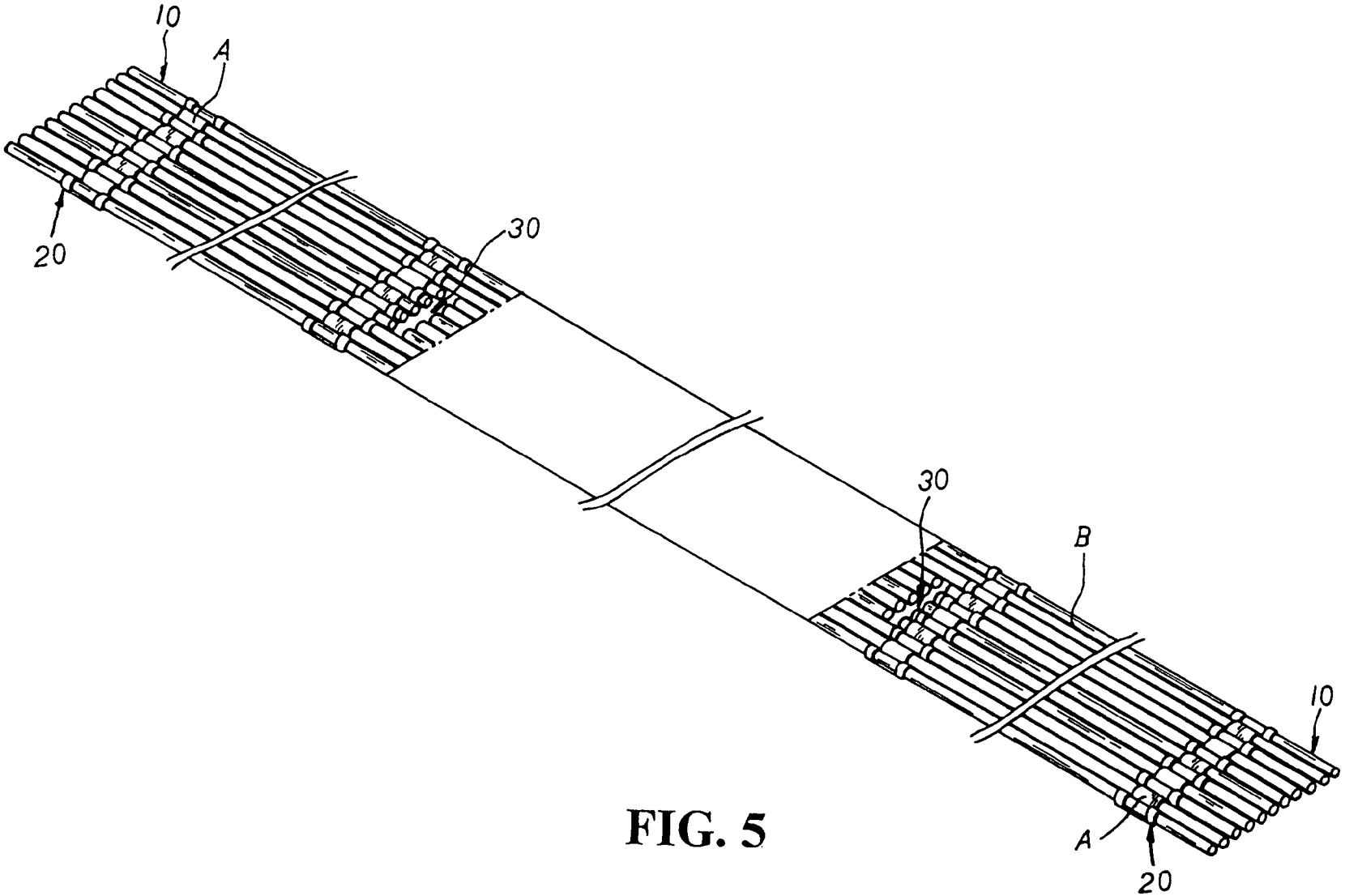
FIG. 5 is a perspective view of the present invention in finished production.

Please refer to FIG. 5. The large half-produced piece of the horizontal rods 10 attached securely together via the binding cords 20 is cut into a blind slat of proper length with two cord-passage holes 30 disposed at both ends thereon. The binding cords of the blind slat are variably changed in colors or patterns for beautiful display of the blind slat thereof. Besides, the blind slat thereof is easily disposed of when out of use since the horizontal rods 10 can be decomposed quickly in soil without causing pollution to the environment thereof.

What is claimed is:

1. A horizontal Venetian blind slat structure comprising:

a) a plurality of horizontal rods;

b) a plurality of spaced apart groups of binding cords, each of the plurality of spaced apart groups of binding cords having a plurality of vertical cords woven with the plurality of horizontal rods;

c) a plurality of fissures located between two of the plurality of spaced apart groups of binding cords and two adjacent rods of the plurality of horizontal rods; and d) cord passage holes located on opposing ends of thereof.

2. The horizontal Venetian blind slat structure according to claim 1, further comprising a fastening glue connecting the plurality of horizontal rods and the plurality of cords.

3. The horizontal Venetian blind slat structure according to claim 1, wherein the plurality of horizontal rods are made of natural materials.

4. The horizontal Venetian blind slat structure according to claim 1, wherein the plurality of horizontal rods are made of bamboo sticks.

5. The horizontal Venetian blind slat structure according to claim 1, wherein the plurality of horizontal rods are made of wooden sticks.

6. The horizontal Venetian blind slat structure according to claim 1, wherein the plurality of vertical cords are made of different colors.

7. The horizontal Venetian blind slat structure according to claim 1, wherein the plurality of vertical cords have patterns located thereon.

* * * * *